US010549296B2

(12) United States Patent
Tada

(10) Patent No.: US 10,549,296 B2
(45) Date of Patent: Feb. 4, 2020

(54) TRIGGER-TYPE SPRAYER

(71) Applicant: CANYON CORPORATION, Sanyo Onoda-shi, Yamaguchi (JP)

(72) Inventor: Tetsuya Tada, Tokyo (JP)

(73) Assignee: CANYON CORPORATION, Sanyo Onoda-shi, Yamaguchi (JP)

( * ) Notice: Subject to any disclaimer, the term of this patent is extended or adjusted under 35 U.S.C. 154(b) by 0 days.

(21) Appl. No.: 15/112,592

(22) PCT Filed: Dec. 29, 2014

(86) PCT No.: PCT/JP2014/006519
§ 371 (c)(1),
(2) Date: Jul. 19, 2016

(87) PCT Pub. No.: WO2015/111126
PCT Pub. Date: Jul. 30, 2015

(65) Prior Publication Data

US 2016/0332179 A1 Nov. 17, 2016

(30) Foreign Application Priority Data

Jan. 22, 2014 (JP) ..... 2014-009919

(51) Int. Cl.
*B05B 11/00* (2006.01)

(52) U.S. Cl.
CPC ..... *B05B 11/3011* (2013.01); *B05B 11/3059* (2013.01)

(58) Field of Classification Search
CPC ..... B05B 11/0029; B05B 11/3059; B05B 11/3011; B05B 1/3436; B05B 11/3057
(Continued)

(56) References Cited

U.S. PATENT DOCUMENTS 4,246,821 A * 1/1981 Fuse ..... B26D 7/00 83/571
4,516,695 A * 5/1985 Garneau ..... B05B 1/12 222/153.14
(Continued)

FOREIGN PATENT DOCUMENTS

JP S52-045921 B1 11/1977
JP H10-128182 A 5/1998
(Continued)

OTHER PUBLICATIONS

English translation of International Search Report for PCT/JP2014/006519.
Supplementary Partial European Search Report of EP14879631.

*Primary Examiner* — Paul R Durand
*Assistant Examiner* — Robert K Nichols, II
(74) *Attorney, Agent, or Firm* — Muncy, Geissler, Olds & Lowe, P.C.

(57) ABSTRACT

A trigger-type sprayer with excellent usability is provided capable of locking rotation of a nozzle part without using a separate component so as not to cause a nozzle orifice to be inadvertently opened. A trigger-type sprayer A of the present invention moves a piston part 3 by pulling and rotating a trigger part to compress liquid in a cylinder part and cause the liquid to be injected from a nozzle part 1 communicating with the cylinder part, and the trigger-type sprayer A includes a lock function of preventing rotation of the nozzle part between the nozzle part 1 and the trigger part 5.

6 Claims, 9 Drawing Sheets

(58) Field of Classification Search
USPC ..... 222/153.13
See application file for complete search history.

(56) References Cited

U.S. PATENT DOCUMENTS

| | | | | |
|---|---|---|---|---|
| 5,169,032 | A | 12/1992 | Steijns | |
| 5,535,952 | A | 7/1996 | Tada | |
| 5,687,880 | A * | 11/1997 | Maas | B05B 11/3011 222/153.14 |
| 6,186,366 | B1 | 2/2001 | Good | |
| 6,244,469 | B1 * | 6/2001 | Knickerbocker | B05B 11/3011 222/153.14 |
| 2007/0056991 | A1 | 3/2007 | Good | |
| 2008/0308655 | A1 * | 12/2008 | Yuan | B05B 11/0029 239/526 |
| 2011/0147419 | A1 * | 6/2011 | Tada | B05B 11/3011 222/383.1 |

FOREIGN PATENT DOCUMENTS

| | | | |
|---|---|---|---|
| JP | 2000-210601 | A | 8/2000 |
| JP | 2001-287763 | A | 10/2001 |
| JP | 2005-349368 | A | 12/2005 |
| JP | 2009-006288 | A | 1/2009 |
| JP | 2009-160573 | A | 7/2009 |
| JP | 2012-179510 | A | 9/2012 |
| WO | 2007/103922 | A2 | 9/2007 |

* cited by examiner

TRIGGER-TYPE SPRAYER

TECHNICAL FIELD

The present invention relates to a trigger-type sprayer and, in more detail, to a trigger-type sprayer having a lock function to prevent inadvertent rotation of a nozzle part.

BACKGROUND ART

As a device for spraying liquid accommodated in a container onto a desired position, a trigger-type sprayer has been conventionally known.

This trigger-type sprayer is a device which causes liquid to be injected by rotating a trigger and using a change in pressure due to compression and depression of an internal pump.

In this case, as a structure of a nozzle part, a nozzle orifice is opened by rotation for injecting, and the nozzle orifice is closed by rotation when not in use.

As such, since the nozzle part is rotated to open and close the nozzle orifice in the trigger-type sprayer, a situation may occur such that a child or others inadvertently rotates the nozzle part to open the nozzle orifice and pulls a trigger part to abruptly inject liquid.

To avoid this situation, a trigger-type sprayer including a function of locking rotation of the nozzle part has been developed.

One has a so-called child-resistant function, and is considered useful as a trigger-type sprayer which ensures safety.

As a trigger-type sprayer including this child-resistant function, for example, a mechanism of locking by the nozzle part itself has been provided (refer to PTL 1).

However, this has a disadvantage of making the inner structure of the nozzle part complex.

On the other hand, one using an independent fixture separate from the nozzle part has been provided (refer to PTL 2).

In this mechanism, an operation lever as an independent component is interposed between the nozzle part and the trigger part, and the trigger cannot be operated at an injection stop position.

That is, a hook part as a part of the operation lever goes round to the back of the trigger to be at the injection stop position, thereby inhibiting operation of the trigger.

However, a nozzle fixture as a separate component has to be prepared and, accordingly, the number of components and the number of assembling steps are increased to cause an overload.

Also, since the operation lever may be caught by a user's finger during operation, usability is not necessarily satisfactory.

Therefore, it has been desired that rotation of the nozzle part can be inhibited without using a separate component to cause an injection stop state.

CITATION LIST

Patent Literatures

PTL 1: Japanese Patent Application Laid-Open No. 2009-6288

PTL 2: Japanese Patent Application Laid-Open No. 2009-160573

SUMMARY OF INVENTION

Technical Problem

The present invention has been made in view of the above circumstances, and has an object of providing a trigger-type sprayer with excellent usability capable of locking rotation of the nozzle part without using a separate component so as not to cause a nozzle orifice to be inadvertently opened.

Solution to Problems

From diligent studies to solve the above problems, the inventor has found that the above problems can be solved by adding a contrivance to at least a side surface of the nozzle part, and has completed the present invention.

That is, the present invention resides in (1) a trigger-type sprayer A in which a piston part 3 is moved by pulling and rotating a trigger part to compress liquid in a cylinder part and cause the liquid to be injected from a nozzle part 1 communicating with the cylinder part, the trigger-type sprayer A including a lock function of preventing rotation of the nozzle part between the nozzle part 1 and the trigger part 5.

Also, the present invention resides in (2) the trigger-type sprayer A according to the above (1), wherein the trigger part is provided with a receiving part 51, the nozzle part 1 is provided with a lug part 11 having a projection, and the projection can fit in the receiving part 51.

Also, the present invention resides in (3) the trigger-type sprayer A according to the above (2), wherein the lug part 11 can be pressed down via a hinge part by forming a slit S in a part of the nozzle part 1.

Also, the present invention resides in (4) the trigger-type sprayer A according to the above (2), wherein the nozzle part 1 is a quadangular cylinder and has opposing surfaces each provided with the receiving part 51.

Also, the present invention resides in (5) a trigger-type sprayer A including a nozzle part 1, a nozzle base part 2 attached to the nozzle part 1, a piston part 3 attached to the nozzle base part 2, a cylinder part which accommodates the piston part 3, a body part 4 integrated with the cylinder part, a cover part attached to the body part 4, and a trigger part 5 pivotally attached to the body part 4.

Also, the present invention resides in (6) the trigger-type sprayer A, wherein the trigger part 5 and the nozzle base part 2 are integrated via an action coupling part 21.

Note that a structure obtained by combining the above aspects of the invention as appropriate can be adopted as long as the structure is in line with the object of the present invention.

Advantageous Effects of Invention

In the trigger-type sprayer A in which the piston part 3 is moved by pulling and rotating the trigger part 5 to compress liquid in the cylinder part and cause the liquid to be injected from the nozzle part 1 communicating with the cylinder part, the sprayer includes a lock function of preventing rotation of the nozzle part between the nozzle part 1 and the trigger part. This can prevent a child or others from inadvertently rotating the nozzle part 1 to cause an injectable nozzle-orifice open state.

Also, since two-step operation is required for injection, safety is provided.

Since a lock function works between the nozzle part 1 and the trigger part 5, application is possible even if the body part 4 is not at a position close to the nozzle part 1.

Unlike the conventional technology, a separate component is not used for locking and unlocking. Therefore, the number of components is small and assembling is advantageously performed.

The trigger part 5 is provided with the receiving part 51, the nozzle part 1 is provided with the lug part 11 having the projection 11C, and the projection 11C can fit in the receiving part 51. Therefore, locking is reliably performed therebetween, and this is simple as a lock structure.

With the lug part 11 forming the slit S in a part of the nozzle part 1, the lug part 11 can be easily pressed down with a fingertip via the hinge part 11B.

The nozzle part 1 is a quadangular cylinder and has opposing surfaces each provided with the receiving part 51. Therefore, with rotation of the nozzle part 1 by 90 degrees, switching is made between a nozzle-orifice open state and a nozzle-orifice close state.

Since the trigger-type sprayer A includes the nozzle part 1, the nozzle base part 2 attached to the nozzle part 1, the piston part 3 attached to the nozzle base part 2, the cylinder part 41 which accommodates the piston part 3, the body part 4 integrated with the cylinder part 41, the cover part 6 attached to the body part 4, and the trigger part 5 pivotally attached to the body part 4, the structure is simple as the trigger-type sprayer A.

Since the trigger part 5 and the nozzle base part 2 are integrated via the action coupling part 21, this action coupling part 21 is deformed to cause the motion of the trigger part 5 to be smoothly and efficiently transmitted as a linear motion of the piston part 3.

Since the trigger part 5 and the nozzle base part 2 are integrated, positioning at the time of assembling is not required.

Also, the number of components is small, and assembling is easy.

DESCRIPTION OF EMBODIMENTS

Figure 1:
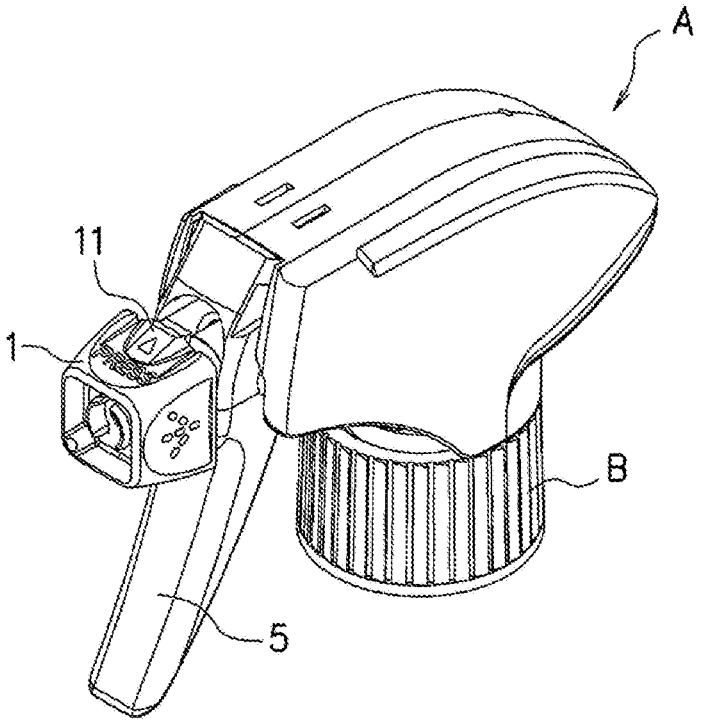
FIG. 1 is a perspective view depicting one embodiment of a trigger-type sprayer according to the present invention.

In the following, a suitable embodiment of the present invention is described in detail, with reference to the drawings as required.

Note that identical components are provided with a same reference character and redundant description is omitted.

Also, a positional relation, such as upper, lower, left, and right, are based on a positional relation depicted in the drawings unless otherwise specified.

Furthermore, the scaling ratio of the drawings is not restricted to be the one depicted in the drawings.

FIG. 1 is a perspective view depicting one embodiment of a trigger-type sprayer A according to the present invention.

Figure 2:
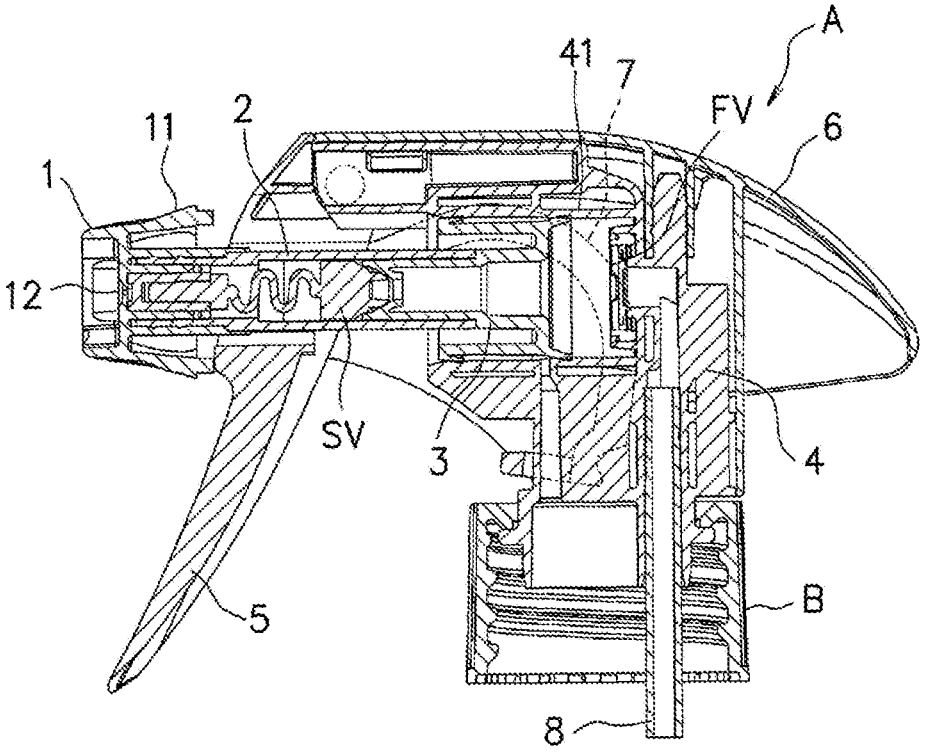
FIG. 2 is a partial sectional view depicting a state before a trigger part of the trigger-type sprayer according to the present embodiment is pulled.

FIG. 2 is a partial sectional view depicting a state before a trigger of the trigger-type sprayer A according to the present embodiment is pulled.

Figure 3:
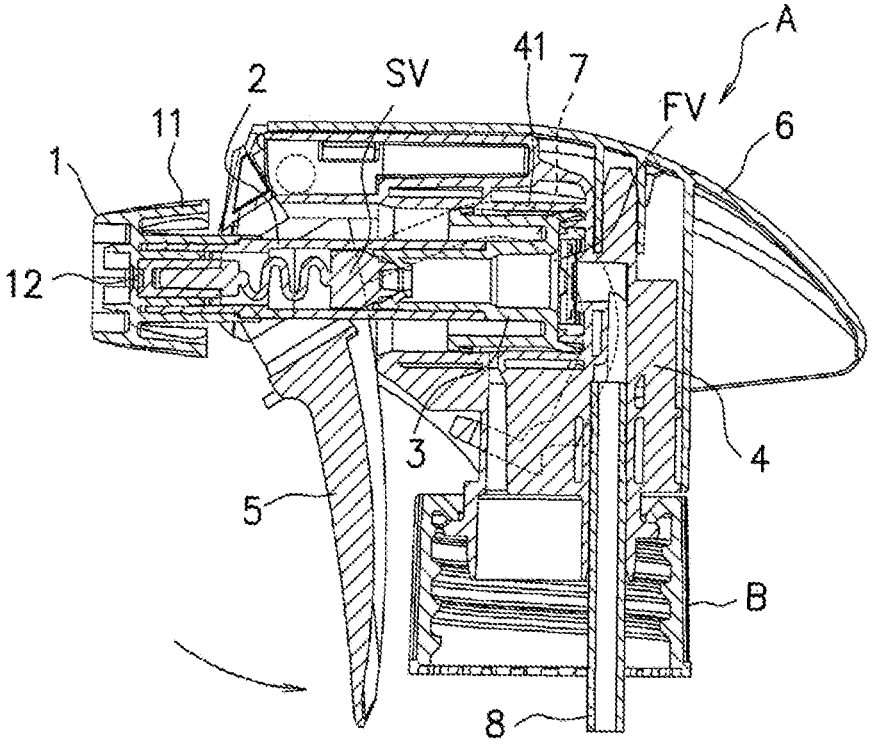
FIG. 3 is a partial sectional view depicting a state after the trigger part of the trigger-type sprayer according to the present embodiment is pulled.

FIG. 3 is a partial sectional view depicting a state after the trigger of the trigger-type sprayer A according to the present embodiment is pulled.

As depicted in the drawings, in the trigger-type sprayer A of the present invention, by pulling and rotating a trigger part 5, a piston part 3 is moved to compress liquid in a cylinder part to cause the liquid to be injected from a nozzle part 1 communicating with the cylinder part 41.

Moreover, the sprayer has a child-resistant function to ensure safety, and therefore is quite useful.

The nozzle part 1 is rotatably attached to a nozzle base part 2. By rotating the nozzle part 1, a passage formed between the nozzle part 1 and the nozzle base part 2 is partially opened or closed to open/close a nozzle orifice 12.

As will be described further below, when the nozzle part 1 is rotated by 90 degrees from a nozzle orifice close state, the state becomes a nozzle orifice open state and, when further rotated by 90 degrees, the state returns to an original nozzle orifice close state.

Normally, in the trigger-type sprayer A, the state is preferably always a nozzle orifice close state when not in use. However, for example, a child or others may inadvertently rotate the nozzle part 1 during playing to cause a nozzle orifice open state.

Thus, liquid may be abruptly leaked to the outside. Furthermore, in this state, when the trigger part 5 is pulled and rotated, the liquid is injected.

To avoid this situation, in the present invention, a lock function is provided to prevent rotation of the nozzle part between the nozzle part 1 and the trigger part so as not to inadvertently rotate the nozzle part 1.

Unless two-step operation as a unique lock function acting between the nozzle part 1 and the trigger part 5 is performed, the state does not become a nozzle orifice open state.

That is, a safe child-resistant function is provided.

This point is a main feature of the present invention.

Next, the lock function is described below in more detail.

Figure 4:
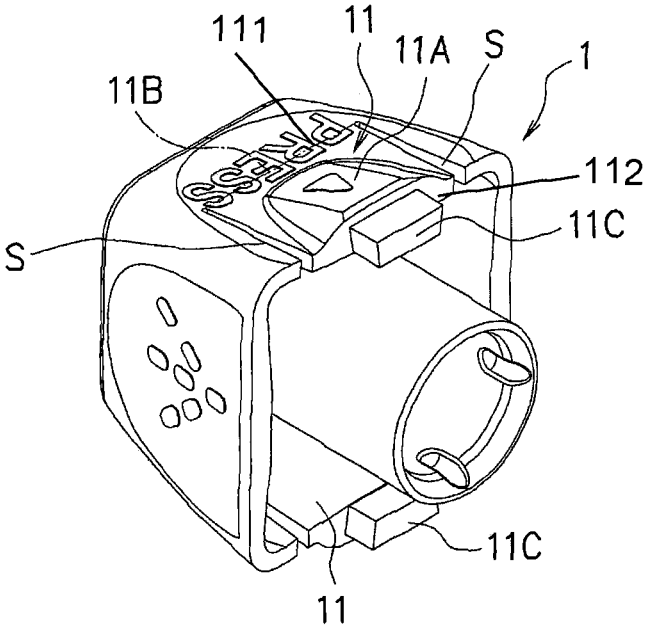
FIG. 4 is a diagram depicting a nozzle part for describing a lock function in the present embodiment.

FIG. 4 is a diagram depicting the nozzle part 1 for describing the lock function in the present embodiment.

The nozzle part 1 is a quadangular cylinder formed to have a rectangular section, has four upper, lower, left, and right side surfaces, and has opposing surfaces (upper and lower surface in the drawing) each provided with a lug part 11.

On both sides of this lug part 11, slits S are formed to be coupled to a nozzle part main body via a hinge part 11B on a first side edge 111 of the lug part 11 as a base part.

With the slits S on both sides, it is possible to elastically press downward with respect to the nozzle part main body by taking the hinge part 11B as a starting point.

Also, an upper surface of the lug part 11 is partially tilted forward to form an inclined surface 11A, and has a projection 11C rearward (in a direction opposite to an injecting direction) on a second side edge 112 of the lug part 11.

By adding a sign such as, for example, a triangle, to this inclined surface 11A, it is easy to visually recognize a position of the lug part 11 to be pressed.

Since the inclined surface 11A of the lug part 11 is tilted forward, pressing-down operation with a fingertip can be performed very easily.

When pressed, the inclined surface 11A of the lug part 11 elastically moves downward. Therefore, with this action, the nozzle part 1 can lock and unlock the trigger part 5.

Figure 5:
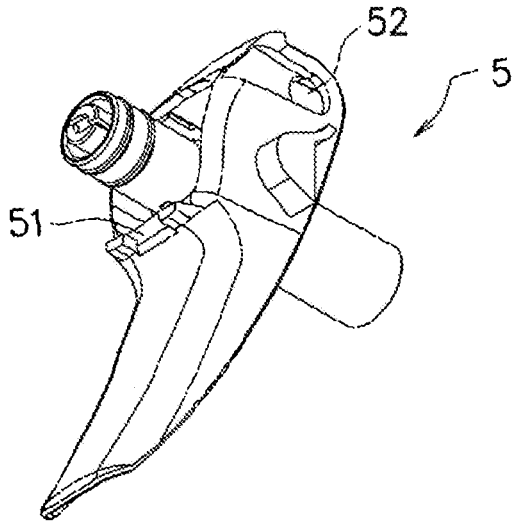
FIG. 5 is a diagram depicting a trigger part for describing the lock function in the present embodiment.

FIG. 5 is a diagram depicting the trigger part 5 for describing the lock function in the present embodiment.

In an upper front portion of the trigger part 5, a receiving part 51 for the projection 11C of the lug part 11 to fit in is formed.

The receiving part 51 is formed of two protrusions on both sides and a space therebetween and is formed in a recessed shape. As will be described further below, the projection 11C of the lug part 11 fits in this space in the receiving part 51.

Next, lock/unlock operation is described.

Figure 6A:
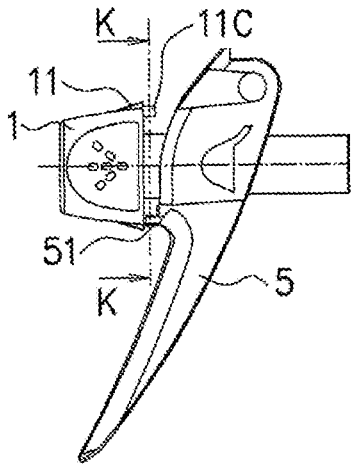
FIG. 6 is a diagram describing operation for unlocking between the nozzle part and the trigger part of the present embodiment, FIG. 6(A) depicting a lock state and FIG. 6(B) depicting an unlock state, each depicting that an upper portion is a side view and a lower portion is a partial sectional view (K-K, O-O).
Figure 6B:
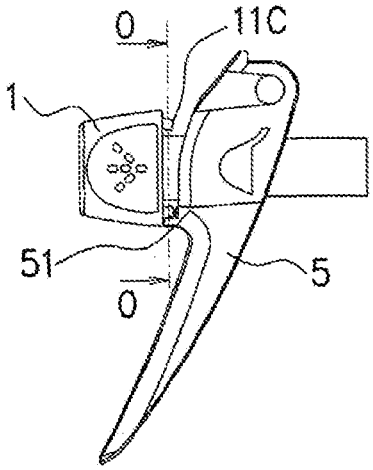
Figure 6B:
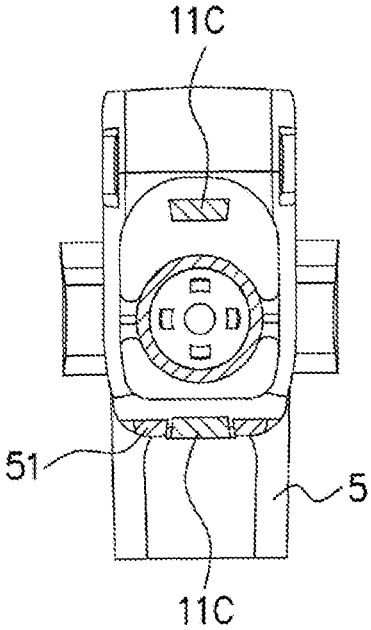
Figure 6B:
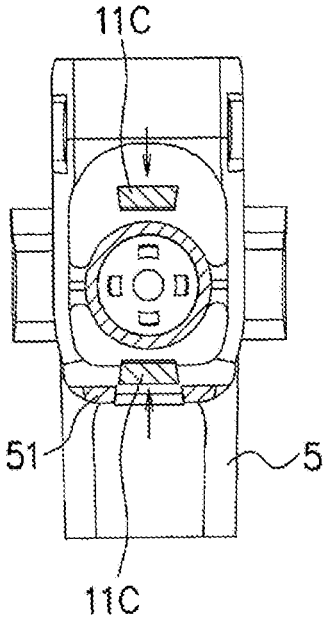

FIG. 6(A) and FIG. 6(B) are diagrams describing operation for unlocking between the nozzle part 1 and the trigger part of the present embodiment, FIG. 6(A) depicting a lock state and FIG. 6(B) depicting an unlock state, each depicting that an upper portion is a side view and a lower portion is a partial sectional view (K-K, O-O).

Figure 7A:
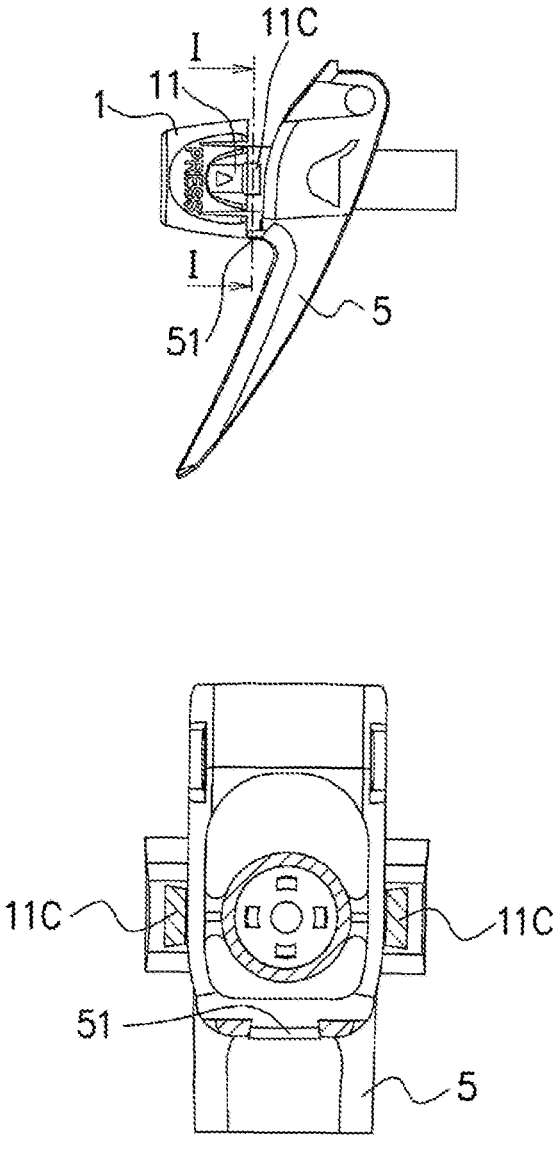
FIG. 7 is a diagram describing operation for locking between the nozzle part and the trigger part of the present embodiment, FIG. 7(A) depicting a nozzle open state and FIG. 7(B) depicting an overriding state, each depicting that an upper portion is a side view and a lower portion is a partial sectional view (I-I, J-J).
Figure 7B:
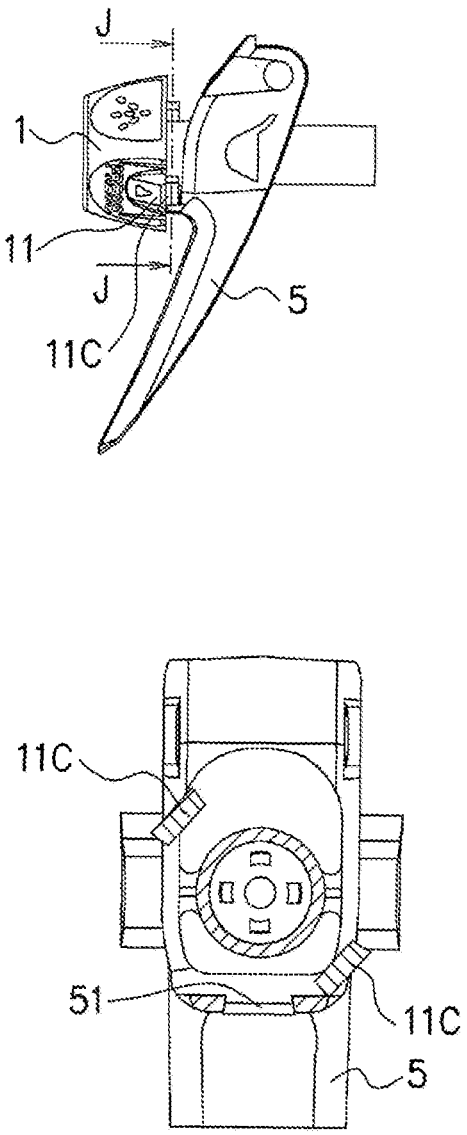

FIG. 7(A) and FIG. 7(B) are diagrams describing operation for locking between the nozzle part 1 and the trigger part of the present embodiment, FIG. 7(A) depicting a nozzle open state and FIG. 7(B) depicting an overriding state, each depicting that an upper portion is a side view and a lower portion is a partial sectional view (I-I, J-J).

First, the nozzle part 1 is assumed to be in a nozzle orifice close state, that is, in a disuse state, as depicted in FIG. 6(A).

At this moment, the projection 11C of the lug part 11 fits in the receiving part 51 of the trigger part 5, and the state is a lock state.

In this state, even if the nozzle part 1 is tried to be forcibly rotated, it is locked and does not move any longer.

For use, the nozzle part 1 has to be in a nozzle orifice open state.

To do this, the nozzle part 1 is pinched by a finger, and the lug part 11 is pressed down by the fingertip (vertical direction in FIG. 6).

Then, the projection 11C of the lug part 11 is released from a state of fitting in the receiving part 51 of the trigger part 5 (lock state), and once becomes an unlock state as depicted in FIG. 6(B).

In this manner, when the state becomes an unlock state, the nozzle part 1 is rotated for rotation by 90 degrees, which causes a nozzle orifice open state as depicted in FIG. 7(A).

In this state, it is possible to pull the trigger part to inject liquid from the nozzle orifice 12.

At the end of use, next, when the nozzle part 1 is pinched by a finger to be rotated for rotation from the nozzle orifice 12 open state by 90 degrees, the state returns to the original nozzle orifice close state as depicted in FIG. 6(A).

Here, when returning to the nozzle orifice close state, the projection 11C at the back of the lug part 11 overrides the receiving part 51 (in detail, the projection of the receiving part 51) of the trigger part 5 to move and fit in the receiving part 51 (in detail, a space in the receiving part 51) as depicted in FIG. 7(B).

For the projection 11C of the lug part 11 to override the receiving part 51 in a manner as described above, a strong force is applied accordingly. As a matter of course, the lug part 11 may be pressed down by a fingertip, and the finger may be released when the projection 11C of the nozzle part 1 matches the receiving part 51 of the trigger part 5 to cause the projection 11C to fit in the receiving part 51.

Once the projection 11C of the lug part 11 fits in the receiving part 51 of the trigger part 5, the nozzle part 1 cannot move any longer even if tried to be rotated in any direction.

With this, a lock state is established between the nozzle part 1 and the trigger part 5, and the nozzle orifice close state is reliably kept.

Thereafter, to cause a nozzle orifice open state again, the lug part 11 is pressed down, and the above is repeated.

As described above, to change a nozzle orifice close state to a nozzle orifice open state, operation (first operation) of pressing down the lug part 11 to change a lock state to an unlock state is first performed, and then operation (second operation) of rotating the nozzle part 1 to cause a nozzle orifice open state is performed.

In detail, in sequence, nozzle orifice close state (lock state)→unlock state (first operation)→90-degree rotation→nozzle orifice open state (second operation)→pulling the trigger part→liquid injection→90-degree rotation→nozzle orifice close state.

In this manner, since two actions, that is, the first operation and the second operation, are required, it is possible to avoid a situation in which a nozzle orifice open state is inadvertently caused and a child or others erroneously injects liquid.

With the child-resistant function capable of ensuring safety with a simple structure as described above, the trigger-type sprayer A of the present invention can be used safely by all people including children irrespective of gender or age, and is also excellent in operability.

Next, a specific example of the trigger-type sprayer A including the child-resistant function as described above is described.

The trigger-type sprayer A of the present invention includes the nozzle part 1, the nozzle base part 2, the piston part 3, the body part 4 integrated with the cylinder part 41, the trigger part 5, and the cover part 6.

Also, between the trigger part and the body part 4, a spring body 7 for pressing the trigger part is provided.

Also, to the body part 4, an F valve FV is attached. To a lower portion of the body part 4, an engaging part with respect to a cap B is provided.

Therefore, the body part 4 is attached to a container not depicted in the drawings as being engaged with the cap B and, by using the function of the trigger-type sprayer A, injects liquid contained in the container from the nozzle orifice 12.

Here, to the nozzle part 1, the nozzle base part 2 is attached by fitting therein. Also, to the nozzle base part 2, the piston part 3 is attached by fitting therein.

In this case, an S valve SV is disposed between the nozzle base part 2 and the piston part 3.

The cylinder part 41 is integrally formed with the body part 4, that is, the body part 4 partially becomes the cylinder part 41.

In this cylinder part 41, the piston part 3 is accommodated. The piston part 3 slides inside the cylinder part.

On the other hand, the trigger part 5 and the nozzle base part 2 are integrated via an action coupling part 21.

Figure 8:
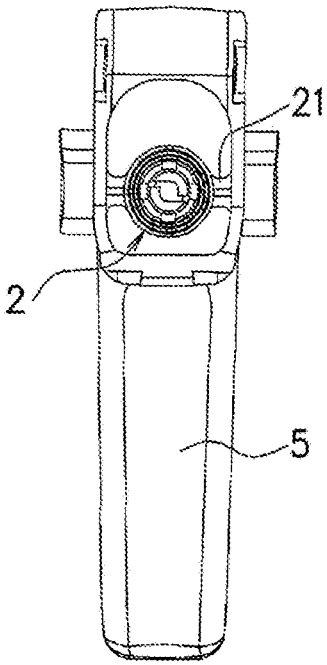
FIG. 8 is a front view depicting a state in which the trigger part and a nozzle base part are integrated via an action coupling part.

FIG. 8 is a front view depicting a state in which the trigger part and the nozzle base part 2 are integrated via the action coupling part 21.

Figure 9:
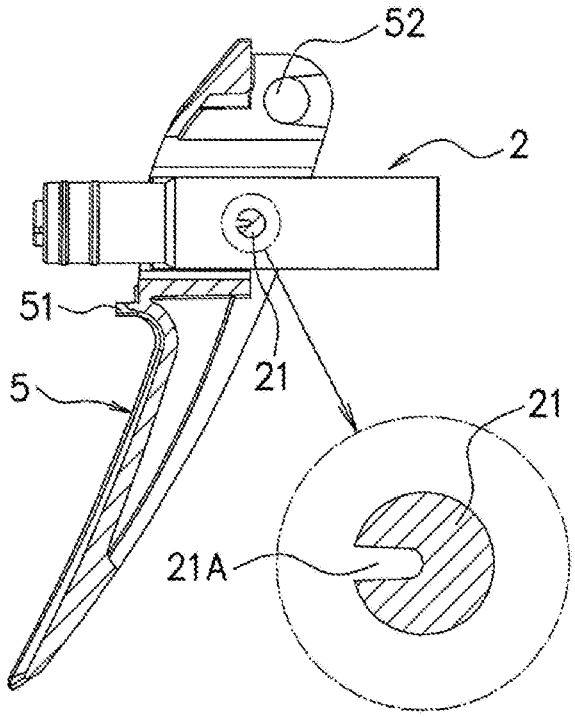
FIG. 9 is a partial sectional view depicting the state in which the trigger part and the nozzle base part are integrated via the action coupling part.

FIG. 9 is a partial sectional view depicting the state in which the trigger part 5 and the nozzle base part 2 are integrated via the action coupling part 21.

This action coupling part 21 is in a columnar shape, projects outward from a side surface of the nozzle base part 2 to couple to the trigger part 5.

When the trigger part 5 is rotated, this action coupling part 21 is deformed by twist or the like to cause the motion of the trigger part 5 to be smoothly and efficiently transmitted as a linear motion of the piston part 3 via the nozzle base part 2.

To make this twist easy, the action coupling part 21 is preferably provided with a V-shaped lateral groove 21A.

Also, since the trigger part 5 and the nozzle base part 2 are integrated, the number of components is small, and assembling is easy.

Also, positioning of both at the time of assembling is not required.

On the other hand, near an upper end of the trigger part 5, a through hole 52 is formed. In the body part 4, a support shaft not depicted projects to both sides.

Therefore, by fitting the support shaft of the body part 4 in the through hole 52 of the trigger part 5, the trigger part 5 is pivotally attached to the body part 4, and can rotate, with the support shaft as a supporting point.

In use, the operation as described above from a nozzle close state is performed twice to open the nozzle orifice, and then the trigger part 5 is pulled and rotated. With this, it is possible to move the piston part 3 to compress the liquid in the cylinder part and cause the liquid to be injected from the nozzle orifice 12 communicating with the cylinder part 41.

The motion of the trigger part 5 can also be smoothly made.

While the embodiment of the present invention has been described in the foregoing, the present invention is not restricted to the above-described embodiment.

While the lug part 11 is provided to each of the two opposing surfaces of the rectangular nozzle part 1 in the trigger-type sprayer A according to the present embodiment, the lug part may be provided to one surface.

In this case, rotation by 90 degrees from a lock state causes an unlock state, further rotation by 90 degrees causes an unlock state, still further rotation by 90 degrees also causes an unlock state, and yet still further rotation by 90 degrees causes a lock state herein.

That is, it is not until rotation by 360 degrees from an initial lock state that the state becomes the original lock state again.

Also, a receiving part provided in place of the projection 11C of the lug part 11 and a projection provided in place of the other receiving part 51 of the trigger part 5 may fit together.

Also, fine asperities for non-slip may be provided to the inclined surface 11A of the lug part 11.

INDUSTRIAL APPLICABILITY

In the trigger-type sprayer A, the piston part 3 is moved by pulling and rotating the trigger part to compress liquid in the cylinder part and cause the liquid to be injected from the nozzle part 1 communicating with the cylinder part 41, and the trigger-type sprayer A includes the lock function of preventing rotation of the nozzle part between the nozzle part 1 and the trigger part. Therefore, a child or others is prevented from inadvertently rotating the nozzle part 1 for injection.

Also, since two-step operation causes a nozzle open state, a high degree of safety is provided.

Since lock/unlock switching operation is performed between the nozzle part 1 and the trigger part 5, even a structure in which the body part 4 is not at a position close to the nozzle part 1 can be applied.

Unlike the conventional technology, a separate component is not used between locking and unlocking. Therefore, assembling with a small number of components is advantageous.

REFERENCE SIGNS LIST

1 . . . nozzle part
11 . . . lug part
11A . . . inclined surface
11B . . . hinge part
11C . . . projection
12 . . . nozzle orifice
2 . . . nozzle base part
21 . . . action coupling part
21A . . . V-shaped lateral groove
3 . . . piston part
4 . . . body part
41 . . . cylinder part
5 . . . trigger part
51 . . . receiving part
52 . . . through hole
6 . . . cover part
7 . . . spring body
8 . . . tube
A . . . trigger-type sprayer
B . . . cap
FV . . . F valve
SV . . . S valve
S . . . slit

The invention claimed is:

1. A trigger-type sprayer, comprising:

a piston part;

a trigger part that is attached to and compresses the piston part;

a cylinder part that holds liquid;

a nozzle part communicating with the cylinder part; and a lock function of preventing rotation of the nozzle part, the lock function being disposed between the nozzle part and the trigger part, wherein the piston part is moved by pulling and rotating the trigger part to compress the liquid in the cylinder part and cause the liquid to be injected from the nozzle part, the trigger part is provided with a receiving part, the nozzle part is provided with two lug parts and two hinge parts, the two lug parts each have a main body and a projection projecting from the main body, the projection can fit in the receiving part, and the hinge parts connect the main body of the lug parts to the nozzle part, each of the two lug parts and each of the two hinge parts are formed as a part of a side surface of the nozzle part, and the hinge parts are formed in front of the two lug parts, respectively, two slits are formed in a part of the nozzle part on both sides of each of the two lug parts to allow each lug part to be pressed down via a respective hinge part, the nozzle part is a quadrangular cylinder and has opposing surfaces each provided with the lug part, and a part of an outer surface of the lug part is an inclined surface, when the projection of one of the two lug parts is received by the receiving part of the trigger part, an entirety of the one of the two lug parts is disposed closer to the receiving part of the trigger part than a corresponding one of the hinge parts connecting the one of the two lug parts to the nozzle part, and the lug parts are provided in the nozzle part so as to extend from the hinge parts toward the trigger part in a direction opposite from an ejection direction of the liquid from the nozzle part.

2. The trigger-type sprayer according to claim 1, further comprising a nozzle base part attached to the nozzle part, the piston part attached to the nozzle base part, a body part integrated with the cylinder part, and a cover part attached to the body part, wherein the cylinder part which accommodates the piston part, and the trigger part is pivotally attached to the body part.

3. The trigger-type sprayer according to claim 2, wherein the trigger part and the nozzle base part are integrated as a single entity via an action coupling part provided with a V-shaped lateral groove.

4. The trigger-type sprayer according to claim 1, wherein the projection of one of the two lug parts are configured to approach the projection of the other one of the two lug parts when the two lug parts are pressed down.

5. The trigger-type sprayer according to claim 1, wherein the main body of each of the lug parts is disposed between by the two slits.

6. The trigger-type sprayer according to claim 1, wherein each of the lug parts includes a first side and a second side opposite from the first side, the first side and a second side each extending in a direction perpendicular to the ejection direction of the liquid from the nozzle part, the hinge part is formed on the first side of the lug part, and the projection is formed on the second side of the lug part.

* * * * *